US005631682A

United States Patent [19]

Takata

[11] Patent Number: 5,631,682

[45] Date of Patent: May 20, 1997

[54] PRINTHEAD INK SUPPLY DEVICE

[75] Inventor: Masayuki Takata, Nagoya, Japan

[73] Assignee: Brother Kogyo Kabushiki Kaisha, Nagoya, Japan

[21] Appl. No.: 234,004

[22] Filed: Apr. 28, 1994

[30] Foreign Application Priority Data

Jul. 6, 1993 [JP] Japan ..... 5-166682

[51] Int. Cl.[6] ..... B41J 2/175

[52] U.S. Cl. ..... 347/86

[58] Field of Search ..... 347/87, 86, 85; 220/570, 902

[56] References Cited

U.S. PATENT DOCUMENTS

| | | | |
|---|---|---|---|
| 4,095,237 | 6/1978 | Amberntsson et al. . | |
| 4,524,365 | 6/1985 | Kakeno et al. | 347/86 |
| 4,589,000 | 5/1986 | Koto et al. . | |
| 4,617,581 | 10/1986 | Koto et al. . | |
| 4,620,202 | 10/1986 | Koto et al. . | |
| 4,771,295 | 9/1988 | Baker et al. . | |
| 4,806,955 | 2/1989 | Koto et al. . | |
| 5,025,271 | 6/1991 | Baker et al. . | |
| 5,119,115 | 6/1992 | Buat | 347/86 |
| 5,155,502 | 10/1992 | Kimura et al. . | |
| 5,156,472 | 10/1992 | Suzuki et al. | 347/86 |
| 5,289,211 | 2/1994 | Morandotti et al. | 347/86 |
| 5,477,963 | 12/1995 | Mochizuki | 347/86 X |

FOREIGN PATENT DOCUMENTS

| | | | |
|---|---|---|---|
| 0408241 | 1/1991 | European Pat. Off. . | |
| 0520695 | 12/1992 | European Pat. Off. . | |
| 0560729A2 | 9/1993 | European Pat. Off. . | |
| 9203206 | 5/1992 | Germany . | |
| 363281850 | 11/1988 | Japan | B41J 3/04 |
| 9008703 | 8/1990 | WIPO . | |

OTHER PUBLICATIONS

Xerox Disclosure Journal; vol. 16, No. 1; Jan. 1, 1991; pp. 11–13; XP 000167941 Fox, J. "Ink Container and Connection Valve for Tij Printing System".

IBM Technical Disclosure Bulletin; vol. 34, No. 1; Jun. 1991; New York, US; pp. 459–462; "Replaceable Ink Cartridge for Ink Jet Print Head".

*Primary Examiner*—Joseph W. Hartary
*Attorney, Agent, or Firm*—Oliff & Berridge

[57] ABSTRACT

A foam unit for storing ink includes a porous member impregnated with ink and a film member wrapped around the porous member. A foam storing case has an opening for allowing insertion and removal of the foam unit into and from the case and a lid adapted to engage with the opening of the foam storing case. When the foam unit is inserted into the foam storing case, an O-ring engages with a projecting portion, and the film is burst by the projecting portion causing the foam member to abut against a filter. Then, a lid is fitted to the opening of the foam storing case. Thus, the foam unit is quickly and neatly replaced, and the ink impregnated in the replaced foam unit can be supplied to a print head.

27 Claims, 6 Drawing Sheets

PRINTHEAD INK SUPPLY DEVICE

BACKGROUND OF THE INVENTION

1. Field of the Invention

The present invention relates to an ink supply device for supplying ink to a print head.

2. Description of Related Art

A conventional ink supply device is disclosed in U.S. Pat. No. 4,771,295, for example. The ink supply device is a head integrated-type ink cartridge having an ink tank to which a print head for jetting ink is integrally mounted. A porous member (which will be hereinafter referred to as a "foam" member) impregnated with the ink is provided inside the ink tank. The ink tank is provided with an ink supply passage for communication between the print head and the inside of the ink tank. A filter is disposed at one end (an ink supply opening) of the ink supply passage opening into the ink tank. Further, the ink tank is provided with an atmospheric air communication hole for communication between the inside of the ink tank and atmospheric air. The ink cartridge is mounted on a carriage. The carriage is reciprocated, and simultaneously the print head is driven to jet the ink, thereby printing desired data on printing paper.

Thus, the foam member impregnated with the ink is enclosed in the ink tank. As compared with an ink cartridge that has only the ink enclosed in the ink tank, the above-mentioned ink cartridge with an open-type ink supply mechanism effectively prevents the leakage of the ink from the atmospheric air communication hole owing to the ink retentivity of the foam member. Furthermore, the ink cartridge buffers a pressure fluctuation in the ink tank caused by movement of the ink due to acceleration upon reciprocation of the carriage.

However, the print head and the ink tank are integral with each other in the head integrated-type ink cartridge mentioned above. Accordingly, in replacing the ink cartridge with another one after fully using the ink, the print head is unavoidably thrown away. As a result, a user must bear the cost of a new print head, thus increasing a running cost.

In recent ink jet printers considering such a problem, an ink cartridge having a replaceable ink tank has been used so that only the ink tank can be replaced with another one. FIG. 6 shows such an ink cartridge in schematic section.

As shown in FIG. 6, an ink cartridge 61 includes an ink tank 56 as a resin case and a foam member 52 impregnated with ink. The foam member 52 is enclosed in the ink tank 56. The ink tank 56 is provided with an ink supply opening 60 for supplying the ink to a print head 50 for jetting the ink. A filter 54 is disposed at the ink supply opening 60. The foam member 52 is in close contact with the filter 54. An atmospheric air communication hole 58 is formed through a wall of the ink tank 56 on a side opposed to the filter 54.

The ink cartridge 61 is removably connected to the print head 50 fixed to a carriage (not shown). When the ink in the print head 50 is consumed by printing, suction maintenance, etc., the ink in the foam member 52 is supplied through the filter 54 to the print head 50. When the ink in the foam member 52 is consumed, the atmospheric air is introduced from the atmospheric air communication hole 58 into the foam member 52, thus ensuring full use of the ink and buffering a rapid pressure fluctuation occurring in performing the suction maintenance or the like.

With this structure, the ink cartridge 61 only can be replaced with another one, and the print head 50 can be repeatedly used within its allowable service life. Thus, as compared with the above-mentioned head integrated-type ink cartridge having the print head and the ink tank integral with each other, the running cost can be reduced.

However, to further reduce the running cost of the ink cartridge 61, it is necessary to provide an ink exchanging means at a low cost. Also, it is required that the user can exchange the ink easily without staining his/her hands.

As such ink exchanging means, there has been proposed a method of injecting the ink by using an injector or the like as disclosed in U.S. Pat. No. 4,589,000. In applying this method using the injector to the ink cartridge 61 to supply the ink into the foam member 52, the foam member 52 continues to be used. Accordingly, the foam member 52 deteriorates by the injector in the course of repeatedly supplying ink and is broken into fine fragments. The fine fragments of the foam member 52 are introduced to the filter 54 together with the ink, thus blocking the filter 54 or entering the print head 50 causing deterioration in print quality. Further, there is a possibility of dust entering the foam member 52 upon injection by the injector causing deterioration in print quality.

When the same injector is repeatedly used to supply ink from an ink container storing a large amount of ink to the ink cartridge 61, good quality ink may not be maintained because of a change in concentration of the ink, solidification of the ink, or entry of dust or the like in the injector or the ink container. This problem has conventionally been eliminated by closely storing the ink in the injector and only using the injector once for the supply of the ink to the ink cartridge 61. However, since the injector is thrown away after use continuously replacing the injector increases costs.

SUMMARY OF THE INVENTION

It is accordingly an object of the present invention to provide an ink supply device that can reduce cost and improve print quality.

To achieve the above mentioned and other objects, an ink supply device of the present invention comprises a foam unit comprising a porous member impregnated with ink and a film member wrapped around the porous member, a foam storing case having an opening for allowing insertion and removal of the foam unit into and from the case, and a lid adapted to engage with the opening of the foam storing case. The foam storing case has a projecting portion projecting inside the case and forming an ink supply passage communicating with the print head. When the foam unit is inserted into the foam storing case, the foam unit is depressed by the projecting portion, and the film member of the foam unit is burst by the projecting portion to allow the ink contained in the porous member to be supplied through the ink supply passage to the print head.

In the ink supply device of the present invention thus constructed, the foam unit having the porous member impregnated with the ink and the film member wrapping the porous member can be inserted into and removed from the foam storing case through the opening thereof. Further, the lid is engaged with the opening of the foam storing case.

As apparent from the above description, according to the ink supply device of the present invention, the foam unit with an ink impregnated porous member and a wrapping film member is removably stored into the foam storing case from the opening thereof, and the lid is engaged with the opening of the foam storing case. Accordingly, the exchange of the ink can be performed by replacing only the foam unit with a new one. That is, the foam storing case for storing the foam unit can be reused without being thrown away, unlike the prior art wherein a case storing a foam member impregnated with ink must be thrown away after the ink is fully used. Thus, the cost of a new case is unnecessary thereby reducing the running cost. Further, since the porous member impregnated with ink is wrapped with the film member, there is no possibility that the user may touch the porous member to stain his/her hands.

DETAILED DESCRIPTION OF PREFERRED EMBODIMENTS

A preferred embodiment of the present invention is described with reference to the drawings.

Figure 1:
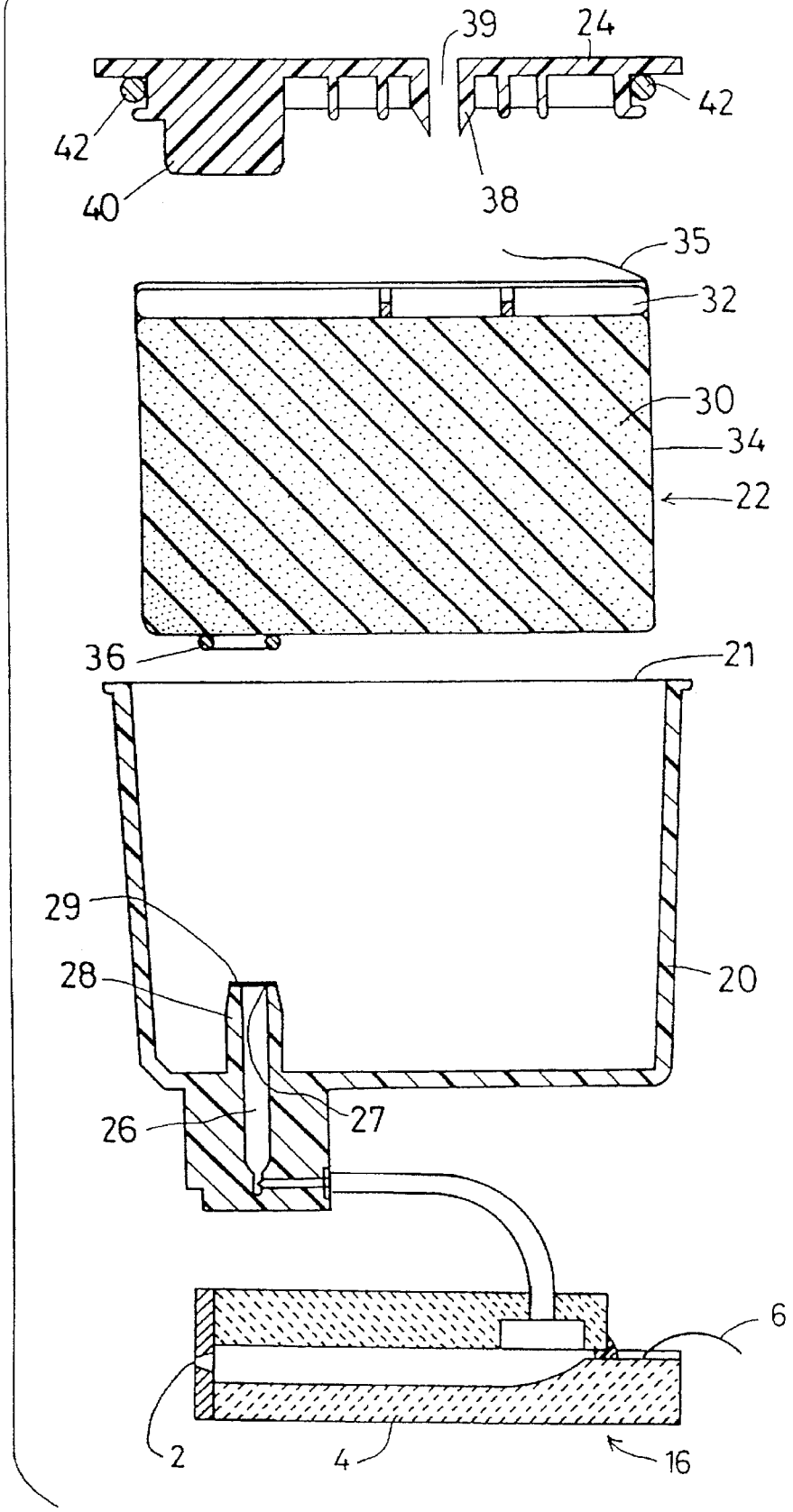
FIG. 1 is an exploded side sectional view showing an ink supply device in a preferred embodiment according to the present invention.
Figure 1A:
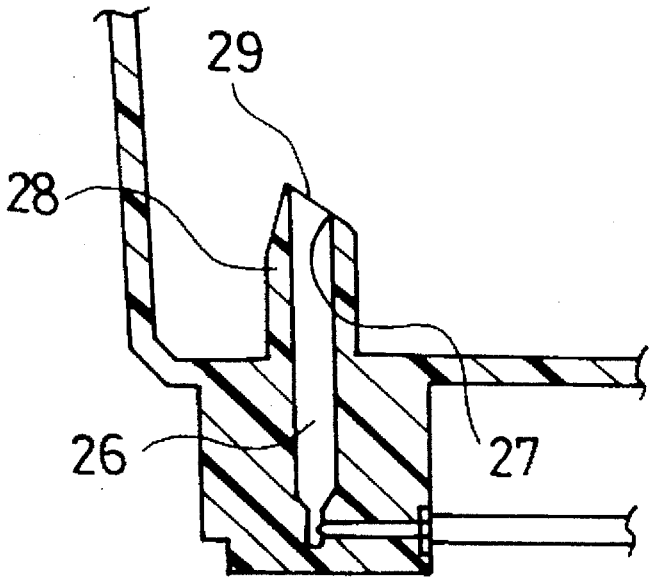
FIG. 1A is an exploded partial side sectional view similar to FIG. 1 showing a modified projecting portion with an inclined tip.
Figure 2:
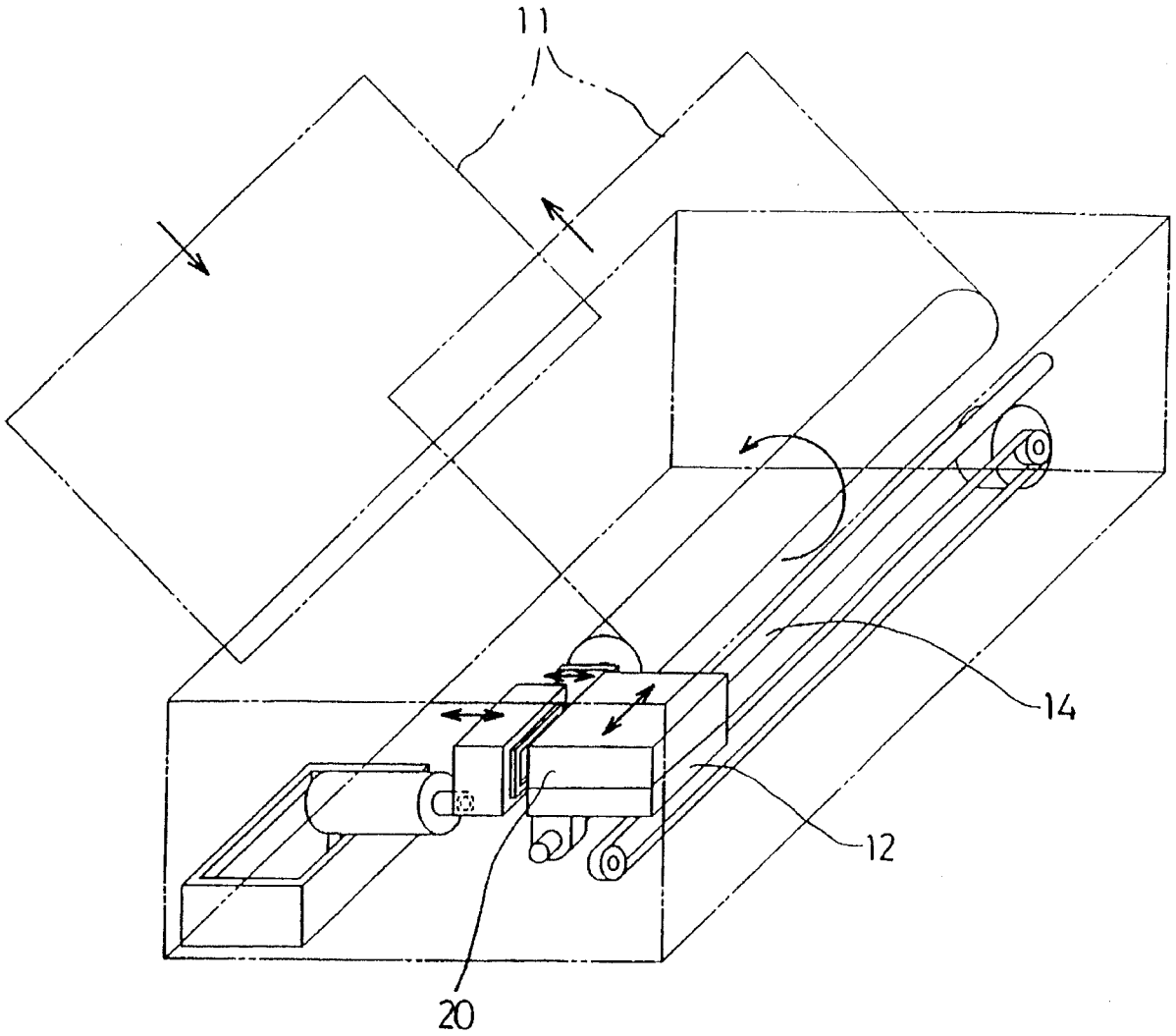
FIG. 2 is a schematic perspective view showing an ink jet printer including the ink supply device shown in FIG. 1.

As shown in FIG. 2, a carriage 12 is slidably mounted on a shaft 14 to reciprocate along the width of a recording paper 11. A print head 16 (see FIG. 1) for jetting ink is mounted on the carriage 12. Further, a foam storing case 20 connected to the print head 16 is also mounted on the carriage 12. Recording of desired data onto the recording paper 11 is performed by reciprocating the carriage 12 and simultaneously driving the print head 16 to jet the ink onto the recording paper 11.

As shown in FIG. 1, the print head 16 includes a nozzle portion 2, a piezoelectric element 4, and an electric connector 6. The piezoelectric member 4 and the connector 6 are connected together by a signal line (not shown). An electric signal corresponding to image information to be recorded is supplied to the connector 6 from outside the print head 16. When the electric signal is supplied, the piezoelectric element 4 is driven to jet the ink from the nozzle portion 2.

Referring to FIG. 1, the foam storing case 20 is provided with an opening 21 from which a wrapped ink impregnated foam unit 22 can be stored or removed. Further, the foam storing case 20 is formed with an ink supply passage 26 for supplying the ink to the print head 16. The ink supply passage 26 communicates at one end thereof with the print head 16 to form an ink channel leading to the nozzle portion 2. The other end of the ink supply passage 26 leads to an upper end of a projecting portion 28 projecting into the foam storing case 20 from the inner wall thereof. The upper end of the projecting portion 28 has an opening serving as an ink supply opening 27. A filter 29 formed of stainless steel or the like is mounted on the upper end of the projecting portion 28. The filter 29 preferably has an aperture size of 20 μm or less.

Figure 3:
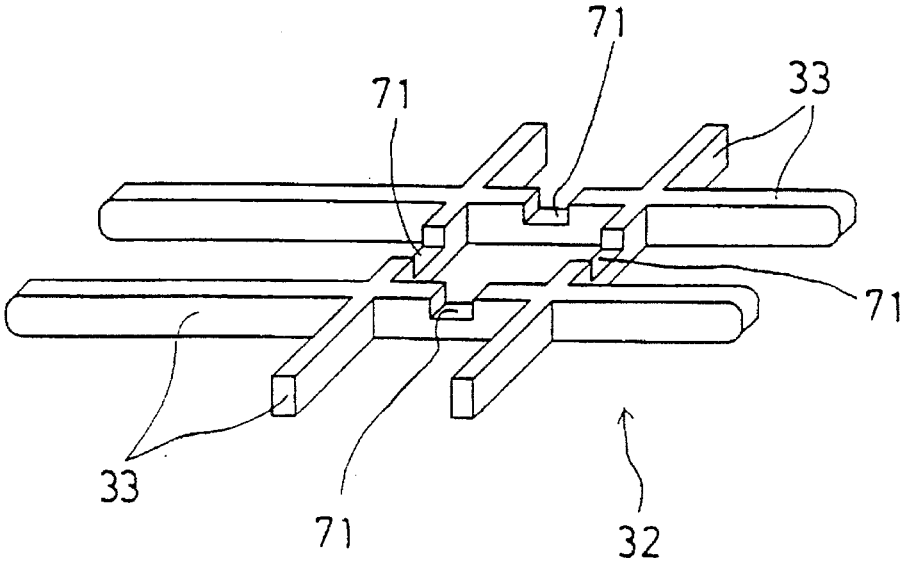
FIG. 3 is a perspective view showing a spacer provided in the ink supply device shown in FIG. 1.

The foam unit 22 includes a foam member 30 impregnated with ink, a spacer 32, and a film 34 such as a high-molecular resin film, tightly wrapped around the foam member 30 and the spacer 32. The film 34 is provided with a handling member 35, such as a tab or pull-strip, identical in material with the film 34. The handling member 35 is designed to be easily picked up by a user so that the user can easily draw the foam unit 22 out of the foam storing case 20. The foam member 30 functions to buffer a pressure fluctuation in the foam storing case 20 caused by movement of the ink due to acceleration upon reciprocation of the carriage 12. The spacer 32 preferably has a shape as shown in FIG. 3, and it functions to smooth the introduction of atmospheric air into the foam member 30. As shown in FIG. 3, the spacer 32 is constructed of four bar members 33 forming a grid portion. The grid portion is provided with four recesses 71 to uniformly communicate the atmospheric air over the surface of the foam member 30 exposed to the spacer 32.

Figure 4:
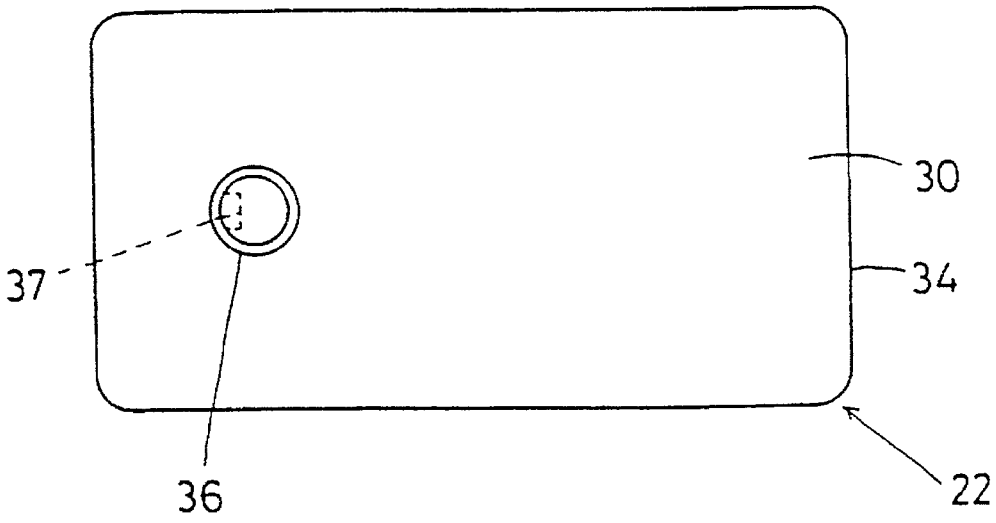
FIG. 4 is a bottom plan view showing a foam unit provided in the ink supply device shown in FIG. 1.

As shown in FIG. 4, an O-ring 36 is bonded to the film 34 on an under portion to engage with the projecting portion 28 of the foam storing case 20 upon insertion of the foam unit 22 into the foam storing case 20. In bonding the O-ring 36, an excess amount of adhesive is applied to the lower surface of the foam unit 22 to form a thick applied portion 37 as shown by a dashed line in FIG. 4 with enhanced strength. The strength of the thick applied portion 37 is set to a value not less than 1.5 times the strength of the film 34.

Figure 5:
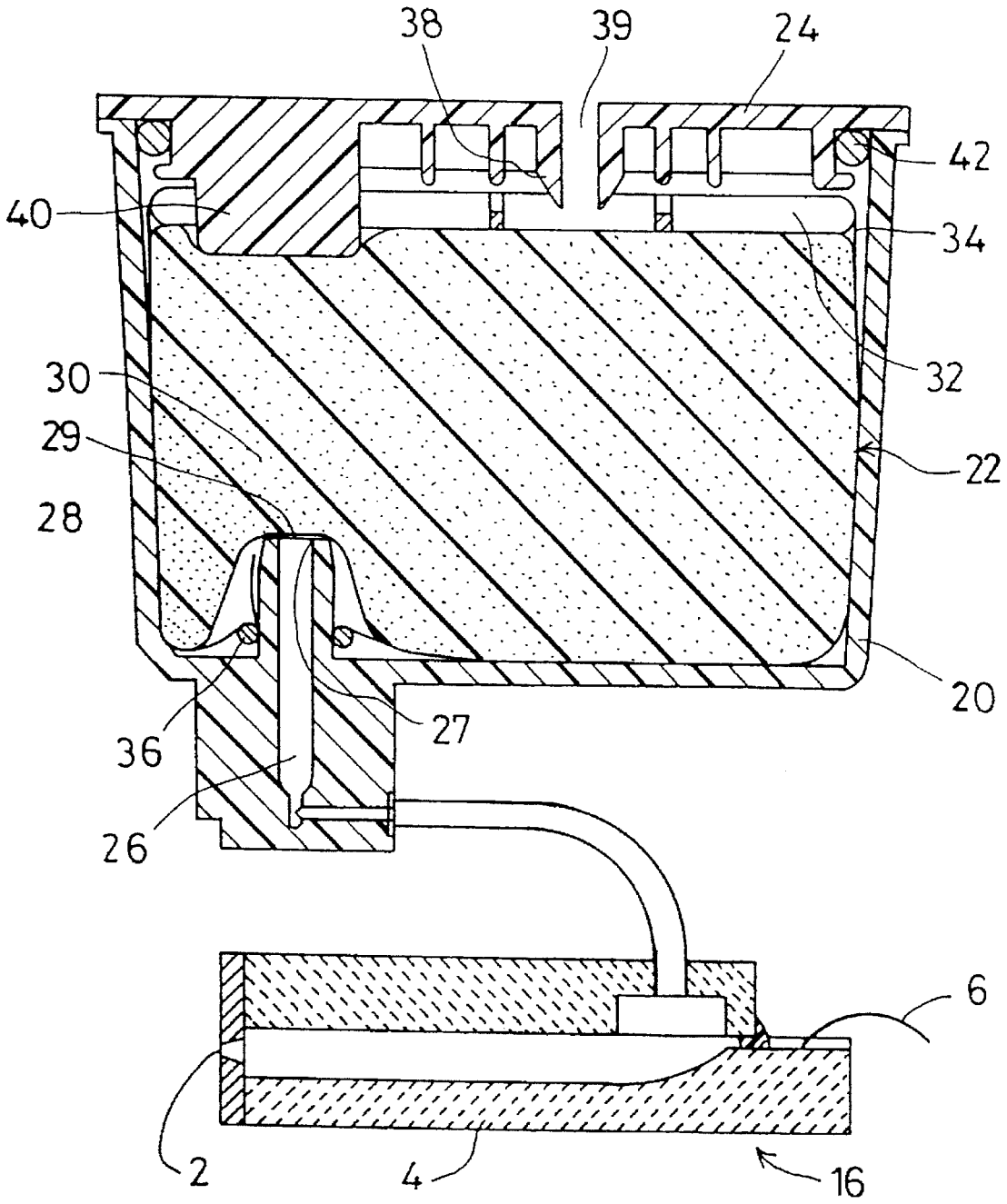
FIG. 5 is a side sectional view showing the ink supply device shown in FIG. 1 in an assembled condition.

A lid 24 seen in FIG. 1 is removably engaged with the foam storing case 20 at the opening 21. The lid 24 is provided with a inwardly projecting portion 38 defining an atmospheric air communication hole 39 and an inwardly projecting portion 40 for depressing the foam unit 22. Further, the lid 24 has an O-ring 42 as a sealing member for sealing the opening 21 when engaging the lid 24 with the foam storing case 20. The assembled ink supply device is shown in FIG. 5.

In operation of the ink supply device, the foam unit 22 is replaced with a new one in the following manner.

First, the lid 24 engaged with the opening 21 of the foam storing case 20 is removed, and the foam unit 22 stored in the foam storing case 20 is drawn out by pulling the handling member 35. Then, another new foam unit 22 is inserted into the foam storing case 20. During the insertion of the foam unit 22, the O-ring 36 first comes into engagement with the projecting portion 28. The film 34 is then burst by the projecting portion 28. As a result, the foam 30 abuts against the filter 29 as shown in FIG. 5. In this preferred embodiment, the strength of the film 34, the hardness of the foam member 30, and the shape of the projecting portion 28, are designed so that when the force applied to the foam unit 22 during insertion into the foam storing case 20 is about 1.5 kgf or greater, the film 34 is burst.

The O-ring 36 functions not only to guide the projecting portion 28 into position but also to enhance sealability so that the ink contained in the foam unit 22 does not leak. Thereby, the ink is prevented from sticking to the inner wall of the foam storing case 20. Further, the O-ring 36 functions also to hold the projecting portion 28 by its own elastic force and thereby prevents the foam unit 22 from being released from the projecting portion 28 by the elastic force of the compressed foam member 30.

Even when the film 34 is burst by the projecting portion 28, the thick applied portion 37 shown in FIG. 4 is not burst because the strength of the thick applied portion 37 is higher than that of the film 34. Therefore, the thick applied portion 37 retains the burst portion of the film 34 as shown in FIG. 5 adjacent to the projecting portion 28. Thus, the burst portion of the film 34 is prevented from covering and closing the filter 29.

It is preferable to preliminarily set an internal pressure in the foam unit 22 higher than the atmospheric pressure. In this case, when the film 34 is burst by the projecting portion 28, the ink contained in the foam unit 22 is automatically introduced into the ink supply passage 26. Alternatively, it is preferable to set a volume of the foam member 30 of the foam unit 22 larger than a capacity of the foam storing case 20. In this case, when the foam unit 22 is inserted into the foam storing case 20, the foam member 30 is compressed, which increases the internal pressure in the foam unit 22. Accordingly, the ink is similarly introduced into the ink supply passage 26.

After the foam unit 22 is completely inserted into the foam storing case 20, the lid 24 is brought into engagement with the opening 21 of the foam storing case 20. At this time, the projecting portion 38 on the lid 24 bursts the film 34. The lower end of the projecting portion 38 is located inside the grid portion of the spacer 32 as shown in FIG. 5, so that the atmospheric air communication hole 39 is brought into communication with the inside of the foam unit 22. Accordingly, atmospheric air is supplied to the foam member 30, and the ink contained in the foam member 30 is therefore smoothly supplied to the print head 16. Similar to the formation of the thick applied portion 37, a strength enhanced portion may be provided on the film 34 at a portion to be burst by the projecting portion 38, so as to prevent the burst portion of the film 34 from completely breaking free and closing the atmospheric air communication hole 39.

The atmospheric air is smoothly introduced from the atmospheric air communication hole 39 into the foam member 30 through the space defined between the foam member 30 and the film 34 by the spacer 32. As compared with the case when the spacer 32 is absent, the ink contained in the foam member 30 can be more fully used, and a rapid pressure fluctuation occurring in suction maintenance or the like can be more buffered.

Further, the spacer 32 ensures a sufficient space between the foam member 30 and the lid 24 to reduce a capillary force between the foam member 30 and the lid 24. Thereby, the ink is prevented from flowing out through the atmospheric air communication hole 39.

When the lid 24 is engaged with the opening 21 of the foam storing case 20, the projecting portion 40 depresses the foam member 30 through the film 34 to thereby introduce the ink into the ink supply passage 26 and simultaneously prevent the foam member 30 from separating from the filter 29.

In the replacement of the foam unit 22 mentioned above, there is a possibility that air bubbles may enter the ink supply passage 26 from the filter 29. To cope with this possibility, the air bubbles are sucked with the ink from the nozzle portion 2, thereby removing the air bubbles in the ink supply passage 26. If the air bubbles reside in the print head 16, a pressure wave in jetting of the ink is damped by the compressibility of the air bubbles to reduce a print quality. Accordingly, such suction maintenance to suck the air bubbles with the ink is necessary. To shorten maintenance time and reduce a suction amount of the ink in suction maintenance, it is desirable that the volume of the ink channel leading from the foam member 30 to the nozzle portion 2 is set as small as possible. In this preferred embodiment, even if the air bubbles enter the ink supply passage 26 from the filter 29 during replacement of the foam unit 22, the ink is also introduced into the ink supply passage 26 by the replacement of the foam unit 22, thereby feeding the air bubbles toward the print head 16. As a result, the volume of the ink channel from the nozzle portion 2 to the air bubbles can be reduced. Accordingly, the removal of the air bubbles by the suction of the ink can be securely performed, and the suction amount of the ink for the removal of the air bubbles can be reduced.

As the filter 29 is brought into pressure contact with the foam member 30, dust or the like can be prevented from entering the print head 16. Furthermore, in the case where the filter 29 has an aperture size as mentioned above, even if the air bubbles in the foam member 30 come into contact with the filter 29, the entry of the air bubbles into the ink supply passage 26 can be prevented by the surface tension of the ink acting on its interface formed at the openings of the filter 29. This effect depends upon the surface tension of the ink to be used. However, it can be enhanced by suitably modifying the aperture size of the filter 29. Further, the shape of the foam member 30 may be suitably designed to exhibit a capillary force of the foam member 30 and the above-mentioned effect of preventing the entry of the air bubbles, thereby allowing printing in any attitude and greatly improving a general-purpose applicability of the printer.

Figure 6:
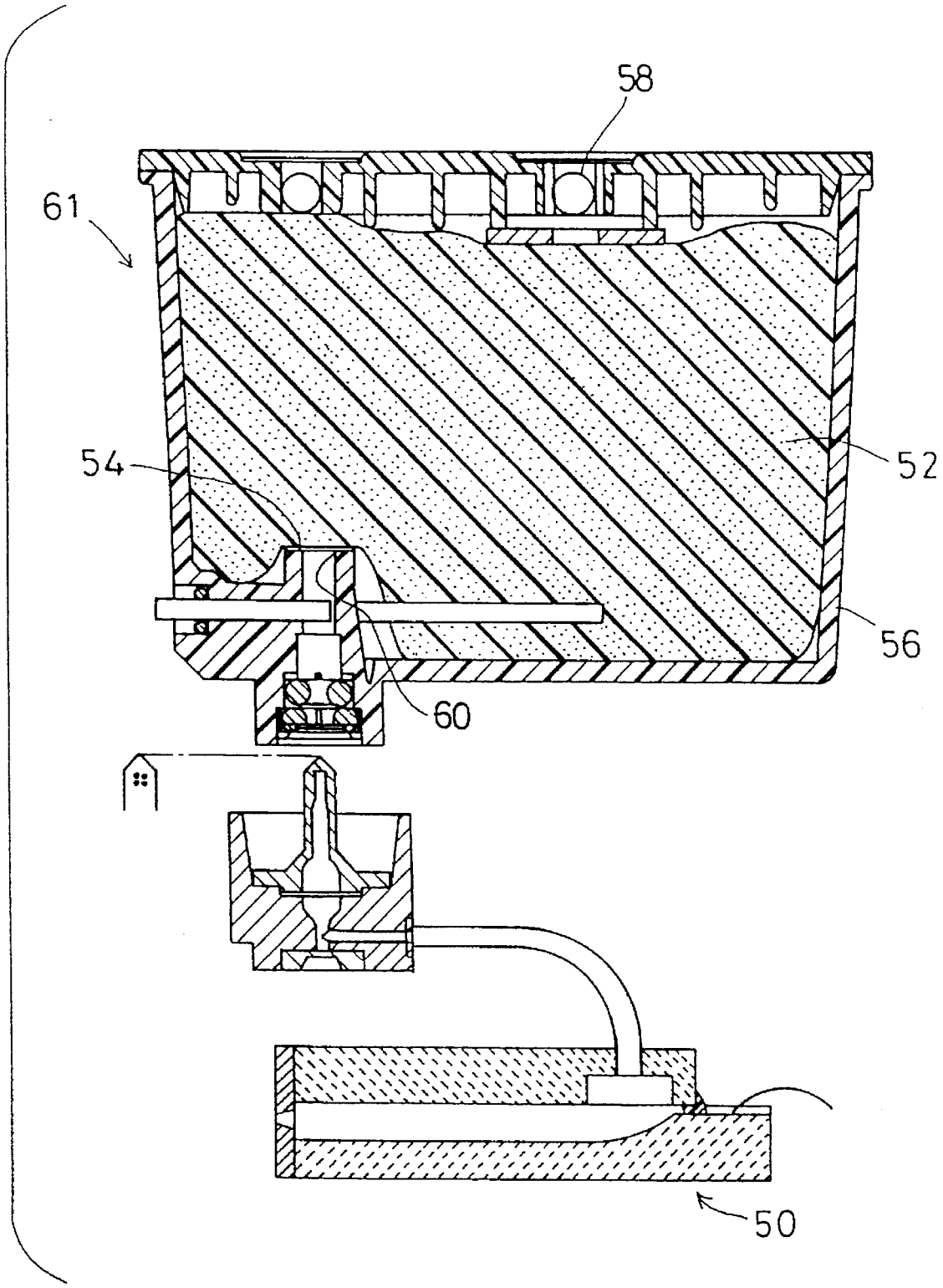
Fig.6 PRIOR ART
FIG. 6 is an exploded side sectional view showing an ink supply device in the prior art.

As mentioned above, the exchange of the ink is performed by removing the foam unit 22 from the foam storing case 20 and then inserting a new one therein. Accordingly, the running cost can be reduced as compared with the prior art wherein the ink cartridge 61 (see FIG. 6) is replaced with a new one. Further, the user can easily exchange the ink without staining his/her hands. In addition, since the foam unit 22 is replaced with a new one, dust or the like having entered from the atmospheric air communication hole 39 sticks to the foam member 30, and is removed together with the foam member 30. Accordingly, dust or the like having entered from the atmospheric air communication hole 39 is prevented from reaching the print head 16, thus having no influence upon ink jetting and ensuring a good print quality.

The film 34 of the foam unit 22 is first burst by the projecting portion 28 of the foam storing case 20 when the foam unit 22 is inserted into the foam storing case 20. Accordingly, there is no possibility that the user may touch the foam member 30 impregnated with the ink to stain his/her hands or the like.

In this preferred embodiment, the film 34 is burst by the projecting portion 28 when the force applied to the foam unit 22 in inserting the foam unit 22 into the foam storing case 20 is 1.5 kgf or more. However, the film 34 may be burst with a force lower than 1.5 kgf by suitably designing the strength of the film 34, the hardness of the foam member 30, and the shape of the projecting portion 28.

In this preferred embodiment, the thick applied portion 37 is provided at a portion of the film 34 to be burst by the projecting portion 28 to prevent the burst portion of the film 34 from closing the filter 29 mounted on the tip of the projecting portion 28. As a modification, the tip of the projecting portion 28 may be so shaped as to incline with respect to the foam unit 22. In this case, when the foam unit 22 is inserted into the foam storing case 20, the film 34 of the foam unit 22 first comes into contact with the front edge of the inclined tip of the projecting portion 28 and is burst by the inclined tip from a position contact with the front edge. Accordingly, the separation of the burst portion from the film 34 does not occur to thereby prevent the closing of the filter 29. As another modification, the tip of the projecting portion 28 may be provided with a projection to burst the film 34 of the foam unit 22 so as not to close the filter 29.

In this preferred embodiment, when the foam unit 22 is inserted into the foam storing case 20, the film 34 is burst by the projecting portion 28. As a modification, when the lid 24 is brought into engagement with the opening 21 of the foam storing case 20, the film 34 may be burst by the projecting portion 28.

While advantageous embodiments have been chosen to illustrate the invention, it will be understood by those skilled in the art that various changes and modifications can be made therein without departing from the scope of the invention as defined in the appended claims.

What is claimed is:

1. An ink supply device for supplying ink to a print head, said ink supply device comprising:

a foam unit comprising a porous member impregnated with ink and a film member wrapping said porous member;

a foam storing case having an opening for insertion and removal of said foam unit into and from said foam storing case, wherein said foam storing case has a projecting portion for bursting said film member, said projecting portion projecting inside said case and forming an ink supply passage communicating with the print head, whereby when said foam unit is inserted into said foam storing case, said foam unit is depressed by said projecting portion, and said film member of said foam unit is burst by said projecting portion to allow the ink contained in said porous member to be supplied through said ink supply passage to said print head; and a lid removably engaging said opening of said foam storing case.

2. The ink supply device according to claim 1, further comprising a filter provided on said projecting portion that abuts against said foam unit.

3. The ink supply device according to claim 1, wherein said projecting portion has an angled surface such that said foam unit is nonuniformly depressed by said projecting portion.

4. The ink supply device according to claim 1, further comprising a sealing member provided on said foam unit positioned adjacent said projecting portion for sealing said foam unit to said projecting portion.

5. The ink supply device according to claim 1, further comprising strengthening means for enhancing strength of said film member of said foam unit in an area depressed by said projecting portion.

6. The ink supply device according to claim 5, wherein said strengthening means comprises a coating of adhesive on said film member.

7. The ink supply device according to claim 1, wherein said lid has a projecting portion opposed to said projecting portion of said foam storing case, whereby when said lid engages with said opening of said foam storing case after said foam unit is inserted into said foam storing case, said foam unit is depressed by said projecting portion of said lid.

8. The ink supply device according to claim 7, wherein said lid has another projecting portion for puncturing said film member of said foam unit and an air communication hole for providing communication between said porous member and atmospheric air.

9. The ink supply device according to claim 8, wherein said foam unit further comprises a spacer defining a space between said porous member and said film member on a side of said foam unit facing said lid.

10. The ink supply device according to claim 1, wherein a volume of said porous member of said foam unit is larger than a capacity of said foam storing case, whereby when said foam unit is inserted into said foam storing case, said porous member is compressed.

11. The ink supply device according to claim 1, wherein said film member is wrapped around said porous member such that an internal pressure in said foam unit is higher than atmospheric pressure.

12. The ink supply device according to claim 1, wherein said foam unit further comprises a handling member for removing said foam unit from said foam storing case.

13. The ink supply device according to claim 1, wherein said foam unit is removably mounted in said foam storing case.

14. An ink supply device for supplying ink to a print head comprising;

an ink tank having an ink supply passage adapted for fluid communication with the print head and a cover with an inwardly protruding projecting sleeve defining an air passage; and a foam unit disposed in the ink tank comprising an ink impregnated foam member wrapped with a film, wherein the foam unit engages with the ink supply passage and has a compressed portion adjacent the ink supply passage, and wherein the projecting sleeve of the cover punctures the film of the foam unit when the cover is closed.

15. The ink supply device of claim 14 wherein the ink supply passage projects inwardly into the ink tank.

16. The ink supply device of claim 15 wherein the inwardly protruding projecting sleeve of the cover is aligned with the inwardly projecting supply passage, the foam unit being compressed therebetween.

17. The ink supply device of claim 15 wherein the ink supply passage has a pointed end.

18. The ink supply device of claim 14 further comprising a sealing member, wherein the film around the foam unit is punctured by the ink supply passage and the foam unit is sealed by the sealing member to the ink supply passage when the foam unit is positioned in the ink tank.

19. The ink supply device of claim 14 further comprising a filter disposed over the ink supply passage between the ink supply passage and the foam unit.

20. The ink supply device of claim 14 wherein the foam unit further includes a spacer disposed between a surface of the foam member and the film, the spacer being disposed on a side of the foam unit opposite to the ink supply passage to provide even air distribution to the foam member.

21. The ink supply device of claim 20 wherein the spacer is a grid member.

22. The ink supply device of claim 14 wherein the foam unit further includes a handling member extending from the film to provide a grasping surface for removal of the foam member from the ink tank.

23. The ink supply device of claim 14 wherein the foam unit has an O-ring formed in the film that sealingly engages the ink supply passage when the foam unit is positioned in the ink tank.

24. The ink supply device of claim 23 wherein the O-ring is adhesively secured to the film and a portion of the film adjacent the O-ring is thickened by the adhesive to control breakage of the film when the foam unit engages with the ink supply passage.

25. The ink supply device of claim 14 wherein the film is wrapped around the foam member so that the foam unit has an internal pressure higher than atmospheric pressure.

26. The ink supply device of claim 14, wherein the wrapping film is configured to define a normal capacity, and the foam member has an internal volume greater than the normal capacity of the wrapping film.

27. The ink supply device of claim 14, wherein said foam unit is removably mounted in said ink tank.

* * * * *